US007786673B2

(12) United States Patent
Allen et al.

(10) Patent No.: US 7,786,673 B2
(45) Date of Patent: Aug. 31, 2010

(54) GAS-FILLED SHROUD TO PROVIDE COOLER ARCTUBE

(75) Inventors: Gary Robert Allen, Chesterland, OH (US); David C. Dudik, South Euclid, OH (US); Viktor K. Varga, Solon, OH (US); Robert Baranyi, Budaors (HU); Agoston Boroczki, Budapest (HU); Elizabeth A. Guzowski, Cleveland Heights, OH (US); Jianwu Li, Solon, OH (US); Rocco T. Giordano, Garfield Heights, OH (US); Svetlana Selezneva, Schenectady, NY (US); Amol S. Mulay, Karnataka (IN)

(73) Assignee: General Electric Company, Schenectady, NY (US)

( * ) Notice: Subject to any disclaimer, the term of this patent is extended or adjusted under 35 U.S.C. 154(b) by 780 days.

(21) Appl. No.: 11/363,598

(22) Filed: Feb. 28, 2006

(65) Prior Publication Data

US 2007/0057610 A1 Mar. 15, 2007

Related U.S. Application Data

(60) Provisional application No. 60/717,087, filed on Sep. 14, 2005.

(51) Int. Cl.
*H01J 17/16* (2006.01)

(52) U.S. Cl. ..... 313/634; 313/25

(58) Field of Classification Search ..... 313/25, 313/634

See application file for complete search history.

(56) References Cited

U.S. PATENT DOCUMENTS 5,253,153 A 10/1993 Mathews et al.

(Continued)

FOREIGN PATENT DOCUMENTS

WO WO 2004/023517 A1 3/2004

(Continued)

OTHER PUBLICATIONS

Applicant provides the following information. General Electric Company sold in the United States before Sep. 1, 2004 a lamp comprising an arctube having a ceramic light-transmitting envelope, the arctube being surrounded by nitrogen gas confined by a shroud, the light-transmitting envelope having an outside diameter of 8.9 mm, the shroud having an inside diameter of 12.1 mm, an outside diameter of 14.5 mm, and a wall thickness of 1.2 mm, the gap between the outside surface of the light-transmitting envelope and the inside surface of the shroud being 1.6 mm.

*Primary Examiner*—Vip Patel
(74) *Attorney, Agent, or Firm*—Pearne & Gordon LLP

(57) ABSTRACT

A lamp is provided having an arctube having a light-transmitting envelope. The arctube is surrounded by a gaseous medium confined by a containment envelope such as a hermetic shroud. The gaseous medium is preferably He or $H_2$ or Ne or another gas whose thermal conductivity is greater than that of $N_2$ at 800° C., or a mixture thereof, to help cool the arctube. The inside and/or outside of the shroud may be coated with a diffusion barrier. To help cool the hot spot of the arctube the gap between the shroud and the envelope can be made small, the portion of the shroud wall near the arc can be thickened, the arctube can be offset above the longitudinal axis of the shroud, and the return lead of the arctube can be located between the shroud and the arctube.

12 Claims, 8 Drawing Sheets

U.S. PATENT DOCUMENTS

| | | | |
|---|---|---|---|
| 5,957,571 | A | 9/1999 | Koster et al. |
| 5,998,915 | A | 12/1999 | Scholz et al. |
| 6,404,129 | B1 | 6/2002 | Hendricx et al. |
| 6,698,913 | B2 | 3/2004 | Yamamoto |
| 6,910,792 | B2 | 6/2005 | Takada et al. |
| 6,948,837 | B2 | 9/2005 | Suzuki |
| 6,953,272 | B2 | 10/2005 | Hayakawa et al. |
| 2004/0108814 | A1 | 6/2004 | Tsuda et al. |
| 2004/0174121 | A1 | 9/2004 | Tsuda et al. |
| 2005/0007020 | A1 | 1/2005 | Tsuda et al. |

FOREIGN PATENT DOCUMENTS

| | | | |
|---|---|---|---|
| WO | WO 2004/051700 | A2 | 6/2004 |

GAS-FILLED SHROUD TO PROVIDE COOLER ARCTUBE

This application claims the benefit of U.S. Provisional Patent App. No. 60/717,087 filed Sep. 14, 2005, the entire contents of which are incorporated herein by reference.

FIELD OF THE INVENTION

The present invention relates generally to discharge lamps and more particularly to a discharge lamp having an arctube which is surrounded by a cooling gas confined by a containment envelope.

DESCRIPTION OF RELATED ART

Existing quartz discharge headlamps have relatively poor optical efficiency because a large amount (about 30% or more) of the light radiated from the arctube must be absorbed in the headlamp system primarily to prevent unwanted glare light in the headlamp beam. Due to various effects, including scattering of the light by the liquid metal halide pool, bowing of the arc, and reflections from the arctube and shroud surfaces, the source of the light appears to be significantly larger than the arc itself. There is a need for a very small arctube for a headlamp, such as an automotive headlamp, whose apparent light source is on the order of about 5 mm long or less and about 2 mm in diameter or less. For good optical performance it is desirable to keep the arctube outside diameter about 2-3 mm or less. There are teachings of ceramic arctubes with extremely small inside and outside diameters, such as WO 2004/023517 A1, but such arctubes have extremely hot inside temperatures. When the outside diameter of a ceramic arctube operating at about 35 W is made about 2 mm with a gap length of about 5 mm, then the hot spot temperature (T3) at the top inside surface of the ceramic arctube reaches greater than 1500 K, typically about 1700 K, whereas one of the requirements for long life (about 3000 hours or more) of the ceramic arctube is T3 less than about 1500 K. There is a need to provide a cooling thermal environment external to the ceramic arctube that lowers the T3 temperature below 1500 K.

SUMMARY OF THE INVENTION

A lamp comprising an arctube having a light-transmitting envelope and a pair of spaced apart electrodes. The arctube is surrounded by a gaseous medium confined by a containment envelope external to the arctube. At least 10% of the moles of the gaseous medium at 25° C. being provided by He or $H_2$ or Ne or another gas whose thermal conductivity is greater than that of $N_2$ at 800 C, or a mixture thereof. The containment envelope can be a shroud. The gap between the outside surface of the envelope and the inside surface of the shroud is preferably smaller than the outside diameter of the envelope. The wall thickness of the shroud is preferably greater than 10% of the inside diameter of the shroud. The arctube has an arc portion. The wall thickness of a first portion of the shroud adjacent the arc portion can be greater than the wall thickness of a second portion of the shroud spaced apart from the first portion. (a) The wall thickness of the shroud or (b) the thickness of the gap between the arctube and the shroud or (c) both the wall thickness of the shroud and the thickness of the gap can vary in a manner effective to beneficially modify the axial temperature gradient of the arctube. The arctube longitudinal axis can be vertically offset from the shroud longitudinal axis in a manner effective to beneficially modify an azimuthal temperature gradient of the arctube.

DETAILED DESCRIPTION OF THE PREFERRED EMBODIMENTS OF THE INVENTION

In the description that follows, when a preferred range, such as 5 to 25 (or 5-25), is given, this means preferably at least 5 and, separately and independently, preferably not more than 25.

Figure 1:
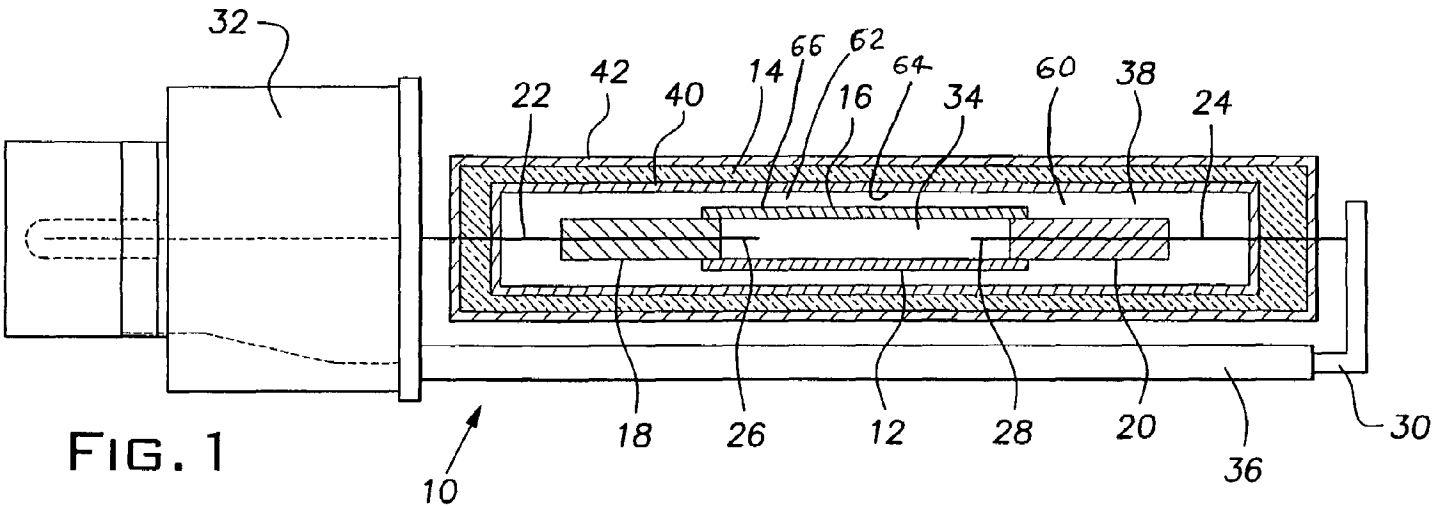
FIG. 1 diagrammatically shows a lamp according to the invention.
Figure 7:
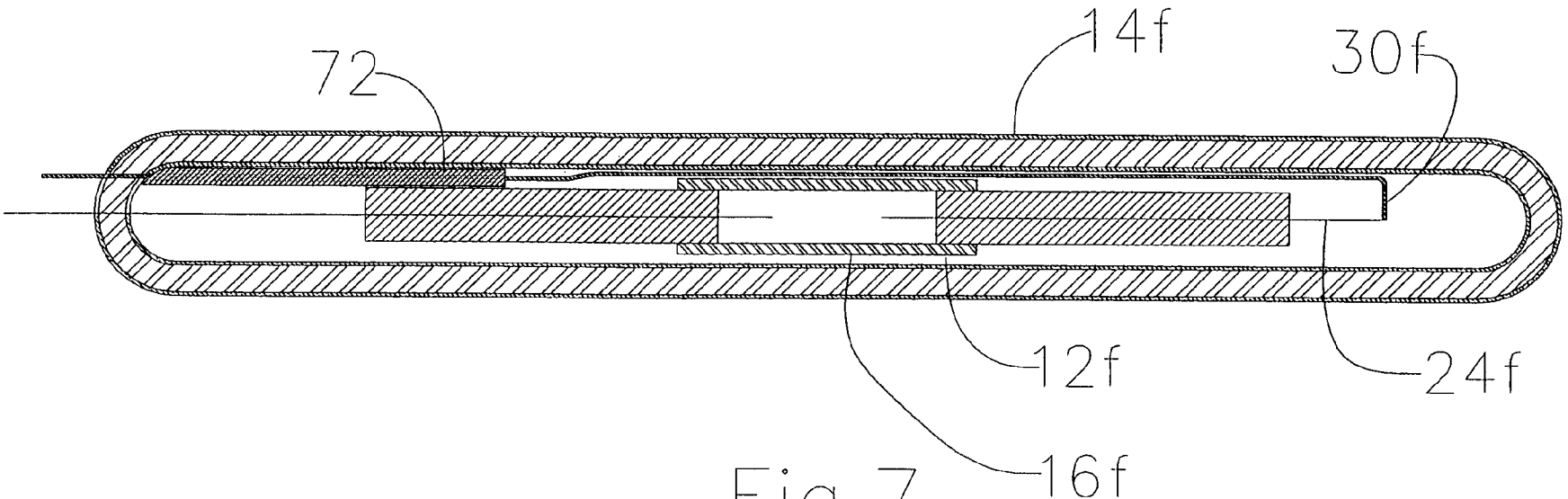
FIG. 7 diagrammatically shows a lamp according to the invention where the electrical return lead of the arctube is positioned vertically above the arctube in the gap between the outside surface of the arctube and the inside surface of the shroud.

With reference to FIG. 1, there is shown a high intensity discharge lamp 10, such as a metal halide lamp, provided with an arctube 12 contained inside a hermetic containment envelope such as a hermetic shroud 14. Arctube 12 contains a discharge space 34 containing a conventional fill. Shroud 14 contains a gaseous medium or gas or cooling gas or cooling gas medium 38 filling a cooling gas space 60 which includes a gap or gap distance 62 between the outside surface 66 of the arctube 12 or envelope 16 and the inside surface 64 of the shroud in the region surrounding the discharge space 34, preferably between the tips of the electrodes 26, 28. Gap 62 is preferably an annular gap, and can be of uniform or non-uniform thickness. Arctube 12 comprises a light-transmitting envelope 16 (shown in FIG. 1 as a tube), preferably cylindrical or alternatively prolate ellipsoidal, spherical or other shape, which is hermetically sealed and at least partially plugged at both ends by first leg 18 and second leg 20, both legs preferably being cylindrical, but may also be pinched geometries with approximately rectangular or other shapes in cross section. Legs 18, 20 can be quartz or ceramic but may be other materials such as molybdenum or other high-temperature metals as known in the art. The arctube 12 and envelope 16 can be quartz or other high-temperature, transparent or translucent material, but ceramic is preferred due to its relatively low permeability for the cooling gas 38, and its high temperature limit which enables a smaller arctube 12. Lamp 10 also includes current conductors 22, 24 which are electrically connected to spaced apart electrodes 26, 28, respectively. Current conductor 24 is fixed to a bent end portion of the lead support 30, which is connected to the base 32 and partially surrounded by an electrically insulating tube such as a quartz or ceramic tube 36, in a conventional manner. Although the lead support 30 is shown external to the shroud 14 forming a double-ended shroud, in some lamp configurations, it may also be internal to the shroud 14 forming a single-ended shroud. In single-ended shroud designs, such as shown in FIG. 7, both of the current conductors 22 and 24 feed through the shroud 14 at the same end, nearest to the base 32. Other than as described herein, the lamp 10 and parts thereof described above are conventional and as known in the art.

The present invention can be used in headlamps and automotive discharge headlamps, but also in all high intensity discharge lamps and less preferably incandescent and LED lamps, and with any light source envelope that can be made smaller and brighter when it is passively cooled by a hermetically sealed gas or passively cooled by a shroud which is tightly fitted around the light source envelope or by a shroud with a thick wall, or by a combination of any of these benefits, as described herein. In an automotive discharge headlamp application, the arctube 12, including envelope or tube 16, is preferably made of polycrystalline alumina, polycrystalline YAG, or other ceramic as known in the art. The distance or arc gap between the tips of the electrodes is preferably 1-7, 2-6, or about 4, mm, and the lamp is preferably operating at 15-1000, 15-500, 15-100, 20-60, 30-40, or about 35, W. The inside diameter of the envelope 16 is preferably less than 2.6, 2, 1.5, 1.4, 1.3, 1.2, 1.1, 1, 0.9, 0.8, 0.7, mm and the wall thickness of tube or envelope 16 is preferably 0.2-1, 0.3-0.8, or about 0.4, mm. The outside diameter of tube or envelope 16 is preferably less than 6, 5, 4, 3, 2.5, 2.3, 2.2, 2.1, 2, 1.9, 1.8, 1.7, 1.6, 1.5, 1.4 or 1.3, mm. The ratio of the distance or gap 62 (between the inside 64 of shroud 14 and the outside 66 of tube 16) to the outside diameter of the envelope 16 is preferably less than 2, 1.5, 1, 0.8, 0.7, 0.6, 0.5, 0.4, 0.3, 0.2 or 0.1 (does not have to be a tight-fitting shroud for the He or other gas to have benefit). If gap 62 is a uniformly thick annular gap, it is preferably less than 2, 1.5, 1, 0.8, 0.7, 0.6, 0.5, 0.4, 0.3, 0.2 or 0.1, mm. Shroud 14 is preferably cylindrical and preferably has a uniform or substantially uniform wall thickness of about 0.5-6 or 1-3 or preferably about 2 mm and preferably has a wall thickness greater than 10, 20, 30, 40, 50, 60, 70, 80, 90, 100, 150 or 200, % of the inside diameter of the shroud and is preferably made of quartz or, if the temperature is low enough, a hard glass such as aluminosilicate glass (such as GE type 180) or other glass with sufficiently high temperature limits. GE type 180 glass typically has the following composition by %: 60.3 $SiO_2$, 14.3 $Al_2O_3$, 6.5 CaO, 0.02 MgO, 0.21 $TiO_2$, 0.025 $ZrO_2$, <0.004 PbO, 0.02 $Na_2O$, 0.012 $K_2O$, 0.03 $Fe_2O_3$, 18.2 BaO, 0.001 $Li_2O$, 0.25 SrO. The shroud preferably has an inside diameter of less than 10, 8, 6, 5, 4, 3, 2.8, 2.6, 2.5, 2.4, 2.2, 2, 1.9, or 1.8, mm, and an outside diameter less than 20, 15, 12, 10, 8, 7, 6, 5.5, 5.3, 5.2, 5, 4.8, 4.6, 4.4, 4.2, 4 or 3.8, mm or greater than 20, 15, 12, 10, 8, 7, 6, 5.5, 5.3, 5.2, 5, 4.8, 4.6, 4.4, 4.2, 4 or 3.8, mm. The inside diameter of the shroud 14 is preferably less than 5, 4, 3, 2, 1.5, 1.2, 1.1, 1, 0.8, 0.6, 0.5, 0.4, 0.3 or 0.2, mm larger than the outside diameter of tube 16. The difference between the outside diameter of the envelope 16 and the inside diameter of the shroud 14 is preferably less than 4, 3, 2, 1, 0.8, 0.5 or 0.3, times the outside diameter of the envelope. Arctube 12 and tube 16 can be centered inside shroud 14 or can be offset or off center inside shroud 14. The arctube 12 and/or the shroud 14 may be non-cylindrical shapes, in which case the above dimensions are measured at the mid-plane between the two electrode tips.

The space between shroud 14 and arctube 12 is filled with gaseous medium or gas or cooling gas 38, which is preferably Ne or more preferably $H_2$ or He or another gas whose thermal conductivity is greater than that of $N_2$ at 800 C, or a mixture thereof, at preferably 0.01-10 or 0.1-10 or 0.1-5, more preferably 0.3-3, more preferably 0.5-2, more preferably about 0.6-1.5, more preferably about 0.8, atm pressure at 25° C. With its high thermal conductivity, this gaseous medium functions as a cooling gas to help cool the arctube 12. The traditional fill in a hermitically sealed shroud is typically $N_2$ gas in the range of 0.1-1.5 atm. Due to the heavier molecular weight of the $N_2$ molecule (amu=28), it has lower thermal conductivity than the lighter gases Ne (amu=20), He (amu=4) or $H_2$ (amu=2). The thermal conductivities (in W/m-K) of the gases of greatest interest at 800 C, which is a typical temperature of the gas 38, are $N_2$=0.07, Ne=0.12, He=0.38, and $H_2$=0.46. As illustrated in FIG. 1, arctube 12 is surrounded by gaseous medium 38 confined by a containment envelope such as shroud 14 which is external to the arctube. Preferably at least 10, 20, 30, 40, 50, 60, 70, 80, 90, 95, 97, 99, or 99.9, % of (a) the moles and (b) the pressure, of the gaseous medium 38 at 25° C. is provided by Ne or He or $H_2$ or another gas whose thermal conductivity is greater than that of $N_2$ at 800 C, or a mixture thereof, more preferably by He. The portion of gaseous medium 38 which is not one of these cooling gases is preferably $N_2$.

One of the functions of gas 38 inside shroud 14 is to inhibit electrical breakdown through the gas across the outside electrical leads of the arctube 12 when the high-voltage (up to about 25 kV) ignition pulse is applied from the ballast. Due to the very high ionization potential of He, He gas might be sufficient to inhibit the breakdown. In some configurations of the lead wires 22 and 24, it may be necessary to include a partial pressure of $N_2$ gas along with the cooling gas 38 in order to suppress electrical breakdown between the leads during ignition of the lamp. In such a case, the partial pressure of $N_2$ relative to that of the cooling gas 38 (preferably Ne, $H_2$ or He) should be limited to the minimum amount of $N_2$ needed to suppress breakdown such that the maximum cooling benefit of the cooling gas is obtained. It is desired to maximize the total thermal conductivity of the gas in the region between the outside of the arctube and inside of the shroud, where the total thermal conductivity of a mixture of gases is found in the literature (Thermal Conductivity of Gases and Liquids, N. V. Tsederberg, The M.I.T. Press, 1965, pp. 144-165) to have several various estimates, mostly of the form:

$$\lambda = \frac{\lambda_1}{1 + A_{12}\frac{x_2}{x_1}} + \frac{\lambda_2}{1 + A_{21}\frac{x_1}{x_2}} \qquad \text{Equation 1}$$

where $\lambda_1$ and $\lambda_2$ are the thermal conductivities and $x_1$ and $x_2$ are the volume fractions of each component gas; $A_{12}$ and $A_{21}$ are coefficients that can depend on the mass and diameter of the components and the temperature. On page 146 of Tsederberg, a representative expression for $A_{12}$ is given as follows ($A_{21}$ has the complementary form):

$$A_{12} = \frac{1}{\sqrt{2}}\left(\frac{d_1 + d_2}{2d_1}\right)\sqrt{\frac{m_1 + m_2}{m_2}}$$

Figure 8:
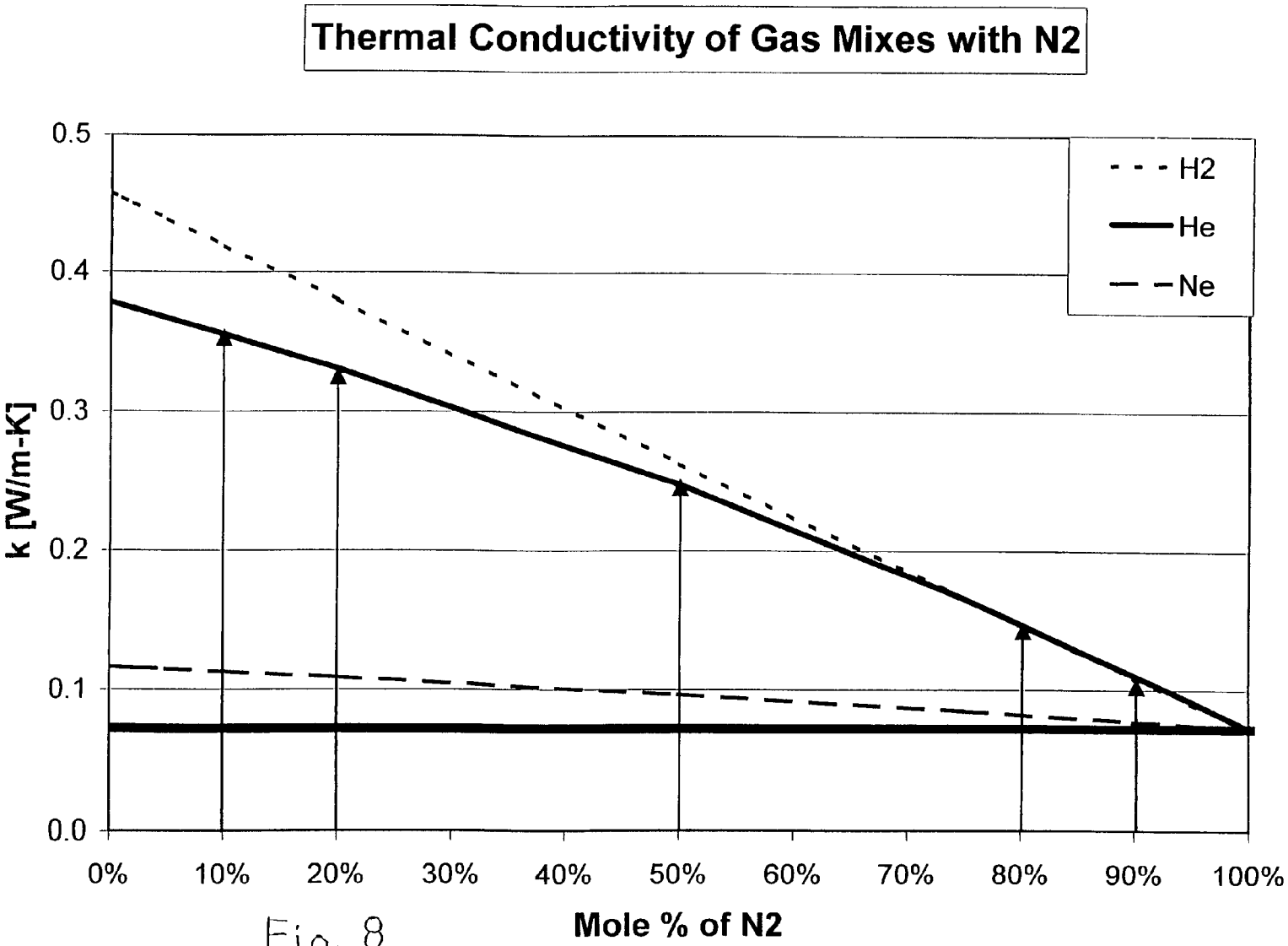
FIG. 8 is a graph showing the thermal conductivity of gas mixes with $N_2$.

The thermal conductivity of the gas mixture using Equation 1 can be plotted as in FIG. 8 which compares the thermal conductivity of gas mixtures with the thermal conductivity of the traditional $N_2$ gas. Each gas mixture in FIG. 8 consists of a mixture of $N_2$ gas of some % between 0-100% with the balance of the mixture being either Ne, He, or $H_2$ gas. It is preferred that the thermal conductivity of the gas mixture should exceed that of $N_2$ gas alone (which is 0.072 W/m-K @ 800 C) by at least 20%, more preferably 50%, 100%, 200%, 300%, most preferably 400%, so that the thermal conductivity of the gas mixture 38 @ 800 C should be at least 0.086, more preferably 0.108, 0.144, 0.216, 0.288, most preferably at least 0.359 W/m-K. So, it is seen that pure He or $H_2$ are excellent cooling gases, and also that Ne is a favorable cooling gas. Further, it can be seen from FIG. 8 that the addition of $N_2$ to He or $H_2$ still provides for a cooling gas (i.e. thermal conductivity significantly exceeding that of $N_2$ alone) even for $N_2$ percentages as high as 80% or 90%. The % of $N_2$ gas in the mixture should be chosen to be the minimum % required to prevent high-voltage breakdown between the lead wires 22 and 24, across which are applied the ignition voltage required to ignite the lamp. Thereby, the greatest cooling advantage of the gas is provided.

Even though $H_2$ and He are the most favored gases based on thermal conductivity, they may be unfavorable due to other lamp design considerations which will vary according to the particular lamp application, such as containment of the cooling gas inside the shroud, or prevention of infusion of the cooling gas into the arctube, or the high-voltage breakdown of the cooling gas during lamp ignition. It is believed that any other gas with a thermal conductivity at 800 C greater than that of $N_2$ can be used as a cooling gas. From the Chemical Properties Handbook, 1999, the thermal conductivity as a function of gas temperature is given for 297 of the most common inorganic gases and for 1296 organic gases. The list of 41 inorganic gases having thermal conductivity @ 800 C exceeding that of $N_2$ (k=0.072 W/m-K @ 800 C) is as follows:

| mol. formula | material or substance name | th cond @ 800 C. |
|---|---|---|
| H2 | hydrogen | 0.457 |
| He | helium-3 | 0.400 |
| He | helium-4 | 0.378 |
| D2O | deuterium oxide | 0.368 |
| D2 | deuterium | 0.338 |
| H3N | ammonia | 0.200 |
| FH | hydrogen fluoride | 0.189 |
| B2H6 | diborane | 0.179 |
| CH4N2 | ammonium cyanide | 0.153 |
| D3N | heavy ammonia | 0.145 |
| B4H10 | tetraborane | 0.137 |
| B2D6 | deuterodiborane | 0.132 |
| CH2BO | borine carbonyl | 0.125 |
| H4Si | silane | 0.125 |
| B5H9 | pentaborane | 0.125 |
| B5H11 | tetrahydropentaborane | 0.120 |
| Ne | neon | 0.117 |

-continued

| mol. formula | material or substance name | th cond @ 800 C. |
|---|---|---|
| N2O4 | nitrogen tetraoxide | 0.115 |
| H2O | water | 0.108 |
| H3NO | hydroxylamine | 0.108 |
| H6Si2 | disilane | 0.098 |
| FH3Si | monofluorosilane | 0.093 |
| B3H6N3 | borine triamine | 0.087 |
| FNO | nitrosyl fluoride | 0.086 |
| H3P | phosphine | 0.083 |
| F3N | nitrogen trifluoride | 0.082 |
| CDN | deuterium cyanide | 0.082 |
| O2 | oxygen | 0.078 |
| H6OSi2 | disiloxane | 0.078 |
| H2O2 | hydrogen peroxide | 0.077 |
| CH4N2O | urea | 0.077 |
| ClH4P | phosphonium chloride | 0.077 |
| F2 | fluorine | 0.077 |
| N2O | nitrous oxide | 0.077 |
| H4N2 | hydrazine | 0.076 |
| NO | nitric oxide | 0.076 |
| F2H2Si | difluorosilane | 0.076 |
| CHN | hydrogen cyanide | 0.075 |
| F2O | fluorine oxide | 0.074 |
| NO2 | nitrogen dioxide | 0.074 |
| HNO3 | nitric acid | 0.073 |

The list of 31 organic gases having at least twice as much thermal conductivity @ 800 C relative to $N_2$ (k=0.072 W/m-K @ 800 C) is as follows:

| mol. formula | material or substance name | min. temp. (K) | max. temp. (K) | th cond @ 800 C. |
|---|---|---|---|---|
| C2F6 | hexafluoroethane | 195 | 700 | 0.272 |
| C6H15N | triethylamine | 273 | 1000 | 0.266 |
| C3H7N | allylamine | 326 | 1000 | 0.214 |
| C4H6 | 1,3-butadiene | 250 | 850 | 0.193 |
| C3H8O | methyl ethyl ether | 273 | 1000 | 0.191 |
| C4H8O | ethyl vinyl ether | 309 | 1000 | 0.185 |
| C3H10N2 | 1,2-propanediamine | 392 | 1000 | 0.181 |
| CH4 | methane | 97 | 1400 | 0.179 |
| C4H8 | cyclobutane | 286 | 1000 | 0.178 |
| C4H10O | methyl isopropyl ether | 304 | 1000 | 0.175 |
| C6H12 | methylcyclopentane | 345 | 1000 | 0.174 |
| C4H6O | divinyl ether | 301 | 1000 | 0.166 |
| C3H6 | cyclopropane | 240 | 1000 | 0.162 |
| C5H12O | methyl isobutyl ether | 332 | 1000 | 0.162 |
| C4H9N | pyrrolidine | 360 | 1000 | 0.160 |
| C4H4O | furan | 305 | 995 | 0.156 |
| C6H10O | cyclohexanone | 400 | 1000 | 0.154 |
| C4H8O | tetrahydrofuran | 338 | 998 | 0.154 |
| C8H18O | di-sec-butyl ether | 394 | 1000 | 0.151 |
| C7H14O | diisopropyl ketone | 398 | 1000 | 0.151 |
| C2H4O2 | methyl formate | 300 | 1000 | 0.151 |
| C3H7N | propyleneimine | 334 | 1000 | 0.149 |
| C5H10O | methyl isopropyl ketone | 368 | 1000 | 0.148 |
| C6H14O | n-butyl ethyl ether | 365 | 1000 | 0.148 |
| C2H7N | dimethylamine | 273 | 990 | 0.147 |
| C6H12O | ethyl isopropyl ketone | 387 | 1000 | 0.147 |
| C4H9NO | morpholine | 401 | 1000 | 0.146 |
| C3H4O2 | vinyl formate | 320 | 1000 | 0.146 |
| C6H12O | butyl vinyl ether | 367 | 1000 | 0.145 |
| C3H6 | propylene | 250 | 1000 | 0.145 |
| C3H6O3 | trioxane | 388 | 998 | 0.144 |

The organic gases are generally not preferred due to the possibility of depositing elemental carbon on the outside of the arctube causing light blockage and overheating.

From among the inorganic gases, excluding those that are highly toxic and those that are prohibitively expensive for lamp applications, and those that are not at least 20% more thermally conductive than $N_2$ in order to be significantly advantageous relative to $N_2$, the list is reduced to the following:

| mol. formula | material or substance name | th cond @ 800 C. |
|---|---|---|
| H2 | hydrogen | 0.457 |
| He | helium-4 | 0.378 |
| H3N | ammonia | 0.200 |
| B2H6 | diborane | 0.179 |
| B4H10 | tetraborane | 0.137 |
| CH2BO | borine carbonyl | 0.125 |
| H4Si | silane | 0.125 |
| B5H9 | pentaborane | 0.125 |
| B5H11 | tetrahydropentaborane | 0.120 |
| Ne | neon | 0.117 |
| N2O4 | nitrogen tetraoxide | 0.115 |
| H2O | water | 0.108 |
| H3NO | hydroxylamine | 0.108 |
| H6Si2 | disilane | 0.098 |
| FH3Si | monofluorosilane | 0.093 |
| B3H6N3 | borine triamine | 0.087 |
| FNO | nitrosyl fluoride | 0.086 |

Further, from this list several favorable candidates are difficult to manage in manufacturing, such as hydrogen, ammonia, and others. He and Ne are safe, inexpensive, chemically inert, and easily dosed in the lamp. He is very favorable, and is the preferred cooling gas when the shroud is designed to contain the He throughout the life of the lamp.

Preferably the moles and partial pressure of $N_2$ gas (and/or some other high-voltage resistant gas or gases other than the cooling gas taught by this invention) is not more than 5, 10, 15, 20, 25, 30, 35, 40, 45, 50, 60, 70, 80, or 90% of the total moles or total pressure of gaseous medium 38 at 25° C. Preferably 0.1-90 or 0.1-80 or 0.1-50 or 0.1-30 or 1-20 or 1-15, or 1-5% of the moles and pressure of gaseous medium 38 at 25° C. is provided by $N_2$.

Figure 2:
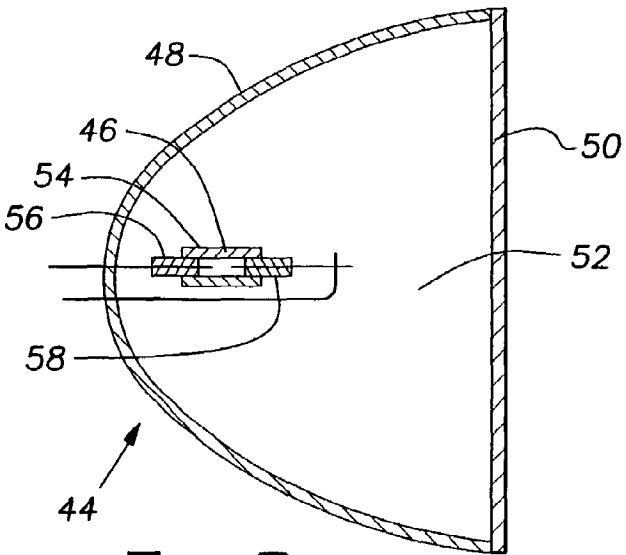
FIG. 2 diagrammatically shows a lamp according to an alternative embodiment of the invention.

At the high operating temperature (usually in the range 400-10° C., more typically about 500-700 C) of shroud 14 in a typical lamp application, the small diameter atoms and molecules of some of the preferred cooling gases having high thermal conductivity ($H_2$, He, Ne, or another gas whose thermal conductivity is greater than that of $N_2$ at 800 C) typically diffuse easily through a quartz shroud. Generally, the smaller, more favorably cooling gases diffuse through quartz more quickly than the heavier, less favorable gases. Typically, more than 99% of the He is lost from a quartz shroud of typical temperature (e.g. 600 C) and typical quartz wall thickness (e.g. 1 mm) in less than 100 hours. Since the typical lifetime of a lamp is 1000 hours or more, this degree of He loss is unacceptable. $H_2$ loss rates through typical shroud materials (quartz and glasses) is typically comparable to, or worse than, that of He, while the loss of Ne and heavier gases is typically better than that of He, but they are less favorable cooling gases. There are several techniques to reduce the diffusion loss of the more preferred cooling gases (especially He and/or $H_2$) through the shroud 14 including, but not limited to: a coating which provides a diffusion barrier on the inside and/or outside surface of the shroud 14, or replacement of the quartz material of shroud 14 with a doped quartz, or glass, or doped glass which has a lower permeability to the cooling gas, or a combination of glass and quartz compositions in one or more shrouds nested within each other, with or without coatings. A suitable coating comprises a thin film or a dip-coating, or a sol-gel such as a transparent or substantially transparent, high-temperature thin film effective to act as a diffusion barrier to prevent or substantially prevent or substantially inhibit or diminish diffusion loss of gaseous medium 38. FIG. 1 shows film 40 on the inside and film 42 on the outside of shroud 14. Film 40 and film 42 can be either a single layer of about 1 um thick coating of tantala or titania or alumina or hafnia or other high-temperature, transparent material, or combinations thereof, or a multi-layer (preferably 2-100, more preferably 3-50, more preferably 5-20, total layers) interference coating as known in the art incorporating titania or tantala or alumina or other high-index, high-temperature optical thin film layer, along with alternatively silica or other low-index, high-temperature optical thin film layers (e.g. tantala-silica or titania-silica interference coatings as known in the art) that serves both as a diffusion barrier to the gas 38 and as an anti-reflection, or wavelength-selective, or directionally selective coating to improve the lamp optics. Tantala is preferred in very high-temperature applications (e.g. >600 C) over titania due to the higher temperature capability of tantala, but the shroud 14 may often be designed to run cool enough that a titania coating can be used, especially on the outside surface of the shroud. The multi-layer or single-layer coating can be applied by CVD, or sputtering, or evaporative, or other techniques known in the art, while the single-layer coating can also be applied by a simpler dipping or spraying process as known in the art. Many glasses typically have lower permeability to He and $H_2$ and the more preferred cooling gases than quartz, including but not restricted to: soda-lime, borosilicate, aluminosilicate, and lead glasses. Considering the preference for unleaded components in lamps, and the need for a high-temperature glass in many lamp applications, the aluminosilicate glasses, e.g. GE type 180 glass, are preferred materials for the shroud material. The anneal temperature of 180 glass is 785 C, which is typically higher than the maximum temperature on the inside of shroud 14, which is typically about 500-700 C. Aluminosilicate 180 glass is also typically used in lamp designs, and good hermetic seals may be attained between 180 glass and typical molybdenum lead wires 22 and 24 of many arctube designs. Accordingly, a preferred embodiment of a He containing shroud is a coated quartz shroud, or more preferably a glass shroud, more preferably a coated glass shroud, or more preferably a coated aluminosilicate glass shroud. Alternately, the containment envelope for containing the cooling gas can be the headlamp reflector together with the lens and appropriate seals, or a sufficiently large and cool shroud (e.g., like shroud 14 except the inside surface of the shroud being spaced apart from the outside surface of tube 16 at least 0.2, 0.4, 0.6, 0.8, 1, 2, 3, 4, 5, 6, 8 or 10, mm) that the shroud material may be glass or metal as known in the art instead of quartz, since glass and metal are known to be better diffusion barriers than quartz for the He and $H_2$. For example, with reference to FIG. 2, there is shown a lamp 44 having an arctube 46 contained within and surrounded by a reflector 48 and lens 50, the reflector 48 and lens 50 forming a containment envelope and hermetically sealingly confining or containing a gaseous medium or gas 52 therewithin, which is the same as gaseous medium or gas 38. Arctube 46 is surrounded and cooled by gaseous medium 52 confined by a containment envelope formed by reflector 48 and lens 50. Arctube 46 includes a light-transmitting envelope 54 which is at least partially plugged at both ends by first leg 56 and second leg 58. Arctube 46 is as generally known in the art and can be similar or identical to arctube 12. Reflector 48 and lens 50 are preferably made impervious or resistant to diffusion loss of gas 52 by making the substrate and/or surface coating thereof metal or glass and/or applying a coating (such as the coatings mentioned herein).

The thermal conductivity of the gaseous medium 38 is independent of the pressure of the gas as long as the gas medium is in the continuum regime, or fluid regime, rather than the molecular regime. The transition from the free molecular regime to the continuum regime occurs where the Knudsen number is <<1. The Knudsen number is a dimensionless fluid parameter equal to the mean free path for collisions in the gas divided by the typical spatial dimension in the gas envelope, in this case the gap 62 between the outside of the arctube and the inside of the shroud. For Kn<0.01 for He cooling gas in a shroud with a 1.0 mm gap 62 spacing to the outside of the arctube, the He pressure must be >200 Torr. So, if about 1 atmosphere (1 bar, 760 Torr) is initially dosed into the shroud during lamp manufacture, then it is sufficient to retain as little as 30% of the initial He amount through the life of the lamp. The required retention of He throughout the life of the lamp can be much less than 30% with some moderate degradation in the cooling effect of the He, and/or if the gap between the shroud and the arctube is >1.0 mm. If there is considerable loss of He throughout the life of the lamp, and if some % of $N_2$ has been added for the benefit of high-voltage breakdown insulation, then the amount of He which must be retained over the life of the lamp should be >about the initial % of $N_2$ in order to retain a significant contribution from the He to the cooling effect on the arctube.

By the use of the cooling gas 38 surrounding the arctube, it is preferred that the T3 temperature inside the arctube be less than 1700, 1600, 1500 or 1475 or 1450 or 1425 or 1400 or 1375 or 1350, K in order to provide longer lamp life.

As an exemplary embodiment, the present invention can be practical in the device described in WO 2004/023517 A1, the contents of which are incorporated herein by reference. WO 2004/023517 A1 teaches 1.5 atm (at 25° C.) of $N_2$ inside the shroud. According to the results of a 3-dimensional finite element thermal model, if this $N_2$ is replaced by 1.5 atm (at 25° C.) of He, the top, center hot-spot temperature T3 inside a ceramic arctube similar to that describe in WO 2004/023517 A1 will be reduced by 240 K for the case of a quartz shroud with a 2 mm thick shroud wall, and an annular spacing between the inside of the shroud and the outside of the arctube of 0.5 mm. The reduction in arctube temperature due to the cooling effect of He vs. $N_2$ will vary depending on the dimensions and temperatures of the arctube and the shroud, but the cooling effect will generally be in the range of about 100-350 K. The thermal advantages of He over $N_2$ can be used for other improvements in the lamp performance, such as reducing the dimensions of the arctube and/or shroud. For example, with reference to WO 2004/023517 A1, if the dimensions of the arctube are kept the same (ID=1.2 mm, OD=2 mm) and the shroud ID=3 mm is retained, then the shroud OD may be made as small as 5.2 mm using He vs. 7 mm using $N_2$ in order to achieve the same T3 temperature. There can be significant advantages in the optical performance of the lamp, or in the manufacturing processes of the lamp that are enabled by the smaller, thinner shroud. Significant reductions in dimensions would also accrue from reducing the ID and OD of the arctube 12 and tube 16. For example, a reduction in the T3 temperature of 240 K would allow for the OD of the arctube to be reduced from about 2.0 mm to about 1.5 mm, with commensurate reduction in the arctube ID. As the ID is made smaller, the arc diameter is reduced in the case of a wall-stabilized arc (i.e. arc gap>>ID) so that the arc luminance (brightness) typically scales in proportion to the arc diameter. Typically, the ID of the arctube may be reduced by about 20-30% by the substitution of $N_2$ by a cooling gas such as He, thereby increasing the luminance by about 20-30%, which can provide a significant performance advantage for the light source in beam-forming applications such as automotive headlamps, or lamps for projectors, fiber optics, etc. Additionally, the reduced ID of the arctube enabled by the cooling effect on the arctube by the cooling gas results in smaller temperature differences between the top and bottom of the arctube since the convection of the high-pressure gas inside the arctube is greatly reduced approximately in proportion to the $ID^{-3}$. So, for example a reduction in arctube ID of about 25% will result in a lower temperature difference by about 2×. Such a reduced temperature difference, together with the lower pressure-driven hoop stresses resulting from the smaller ID, can significantly reduce the stresses in the arctube envelope, providing a potential for longer lamp life. Additionally, the cooling effect on the arctube by the cooling gas can enable a shortening of the arctube and/or of the arc gap by similar amounts, also thereby increasing the luminance of the light source. The thermal advantages of the cooling gas 38, such as He, can also be combined with the cooling advantage that accrues from reducing the gap between the outside of the arctube and the inside of the shroud, and also by increasing the outside diameter of the shroud (or equivalently, increasing the wall thickness of the shroud). These other two advantages of the shroud design for the cooling of the arctube are comparable to the advantage offered by the cooling gas, as can be appreciated as follows. The thermal path for the heat dissipated at the arctube wall has 4 substantial elements, including the thermal conductance through the wall of arctube 12, the thermal conductance through the gas medium 38, the thermal conductance through the wall of shroud 14, and finally the heat transfer, typically by convection and radiation, to the outside ambient air. Analysis of the heat transfer equation in cylindrical geometry, including typical values for the thermal conductivities of the arctube 12, the gas medium 38, and the shroud 14, along with the coefficients for the heat transfer from the outside of the shroud 14 to the ambient, indicate that the dominant limitations to the overall heat transfer and resultant cooling of the inside of the arctube are due to the thermal resistance of the gas medium 38, and the heat transfer from the outside of the shroud to the outside ambient air, whereas the thermal conduction through the wall of the arctube 12 and through the wall of the shroud 14 do not affect the arctube temperatures as much as the other two thermal elements. The first limiting element, the thermal resistance through the gas medium 38 is approximately proportional to the thickness of the gap 62 between the outside of the arctube and the inside of the shroud, and inversely related to the thermal conductivity of the gas medium. Therefore, if the thermal conductivity of the gas medium can be increased to about 4 times the value of the typical $N_2$ gas, by replacing it with He gas, then a comparable thermal advantage can be made by reducing the gap 62 from about 2 mm to about 0.5 mm for the dimensions typical of a discharge headlamp. In fact, the thermal model confirms that reductions in T3 of at least 100-200 C are obtained by reducing the gap 62 from about 2 mm to about 0.5 mm, enabling an even cooler and/or smaller arctube. It is usually difficult in lamp manufacture to reduce the gap 62 significantly below about 0.5 or 0.25 mm. In general, the thermal benefit of a small gap 62 will be significant if the gap is <the outside diameter of the arctube, more preferably <0.5 arctube OD, or more preferably <0.25 arctube OD, or most preferably <0.1 arctube OD. Furthermore, if the heat transfer from the outside of the shroud to the ambient air can be increased, the cooling effect on the arctube can be further increased, enabling an even cooler and/or a smaller arctube. The heat transfer, typically by convection and radiation, from the outside of the shroud to the ambient air is typically proportional to the outside surface area of the shroud, which is typically proportional to the outside diameter, OD, of the shroud if the geometry is cylindrical, or nearly cylindrical. So, for example increasing the OD of the shroud by about 20-50% or more can significantly reduce the temperature of the arctube, and/or enable a smaller arctube. Given that the ID of the shroud is determined by the OD of the arctube and the gap 62 between the outside of the arctube and the inside of the shroud, then increasing the outside surface area of the shroud requires either a thicker shroud wall, or a textured or convoluted outside surface on the shroud. For example, for the typical dimensions of a discharge headlamp with a shroud OD of about 5 to 10 mm, and a shroud wall thickness of typically 1 mm, then doubling the shroud wall thickness to 2 mm, will increase the shroud OD and increase the heat transfer from the outside surface of the shroud by about 40% to 20%. The thermal benefit of a thicker shroud continues to increase with increasing shroud wall thickness until it reaches a thickness referred to as the critical radius. For the dimensions of a typical discharge headlamp with a quartz or glass outer jacket, the critical radius is about 160 mm. Although it becomes exceedingly difficult to manufacture lamps with shrouds much thicker than about 1-3 mm, nonetheless, the thermal benefit to a cooler and/or smaller arctube will continue to improve if the quartz or glass shroud can be made much thicker, up to a limiting thickness of about 160 mm. In fact, the thermal benefit to the hottest spots in the arctube, which are generally above the arc, between the electrodes, can be obtained if the shroud wall is thick only along the section of the arctube which is adjacent to the arc gap, as in FIGS. 3 and 4. The shroud wall may be significantly thinner in the section of the shroud along the legs of the arctube and in the seal region beyond the arctube legs, so that the thinner wall of the shroud in the seal region beyond the legs will simplify the hermetic sealing of the shroud. Furthermore, the small gap 62 between the outside of the arctube and the inside of the shroud needs to be small only in the region adjacent to the arc gap for the same reason. The hottest parts of the arctube in the region of the arc, are significantly cooled by the proximity of the shroud to the arctube in that region, and the shroud need not be so close to the arctube in the leg region which is generally cooler. This is the case shown in FIG. 1. In general, the thermal benefit of a thicker shroud wall will be significant if the shroud wall thickness is >10% of the shroud inside diameter, more preferably >20%, 30%, 50% or 75% of the shroud ID, or more preferably >100% of the shroud ID. The advantages of a cooler and/or smaller arctube provided by the cooling gas, and the gap 62, and the OD of the shroud can be combined such that the combination of any two or all three of the advantages is greater than the advantage of any one effect alone.

Considering that the cooling effect of the shroud is greatly enhanced as the gap 62 is reduced and/or the shroud wall thickness is increased, then it is possible to tailor the temperature distribution in the arctube by varying the dimensions of the gap 62 and/or the shroud wall thickness along the extent of the arctube. In particular, it is desirable to decrease the temperature of the hottest spot of the arctube which is typically centrally above the arc in a horizontally burning arctube, while increasing the temperature of the coldest spot in the arctube where the liquid metal halide pool generates the desirably high vapor pressure of the light-producing gases in the arctube, which is typically located in the bottom corner of the inside of the arctube, below and/or behind the electrodes. So, it is generally desirable to decrease the arctube temperature in the regions near the center of the arc and above the arc, while increasing the arctube temperature in the regions below the arc and below and behind the electrodes. While these temperature differentials are detrimental to the performance of the lamp in that the cold spot temperature can be too low, and also detrimental to the strength of the arctube if the hot spot is too hot, the temperature gradients themselves also generate stresses in the arctube, which especially in ceramic arctubes, can cause early failure of the arctube due to cracking or leaking. The particularly concerning stresses in a horizontally burning arctube are driven by the azimuthal temperature gradients (i.e. from top to bottom, especially in the region at the center of the arc) and the axial temperature gradients (i.e. from center of the arc to ends of the legs, especially in the region near the electrodes). Increasing the performance of the arctube by raising the cold spot temperature relative to the hot spot, or increasing the strength of the arctube by lowering the hot spot temperature, or increasing the life of the lamp by reducing the stresses in the arctube all can be achieved either by reducing the ID of the arctube which is enabled by the cooling effect of the shroud design including the cooling gas 38 and the reduced gap 62 and the increased wall thickness of the shroud 14, or by tailoring the thickness of the gap 62 between the outside of the arctube and the inside of the shroud and/or tailoring the thickness of the shroud wall as a function of the axial and/or azimuthal location along the arctube. For example, to reduce the hot spot temperature, the shroud wall can be made thicker along the arc region of the arctube, as in FIGS. 3 and 4, and/or the arctube could be mounted vertically above the axis of the shroud, as in FIG. 5, so that the gap between the outside of the arctube and the inside of the shroud is less above the arctube than it is below the arctube. By mounting the arctube above the axis of the shroud the stresses driven by the azimuthal temperature gradient will also be reduced.

Figure 3:
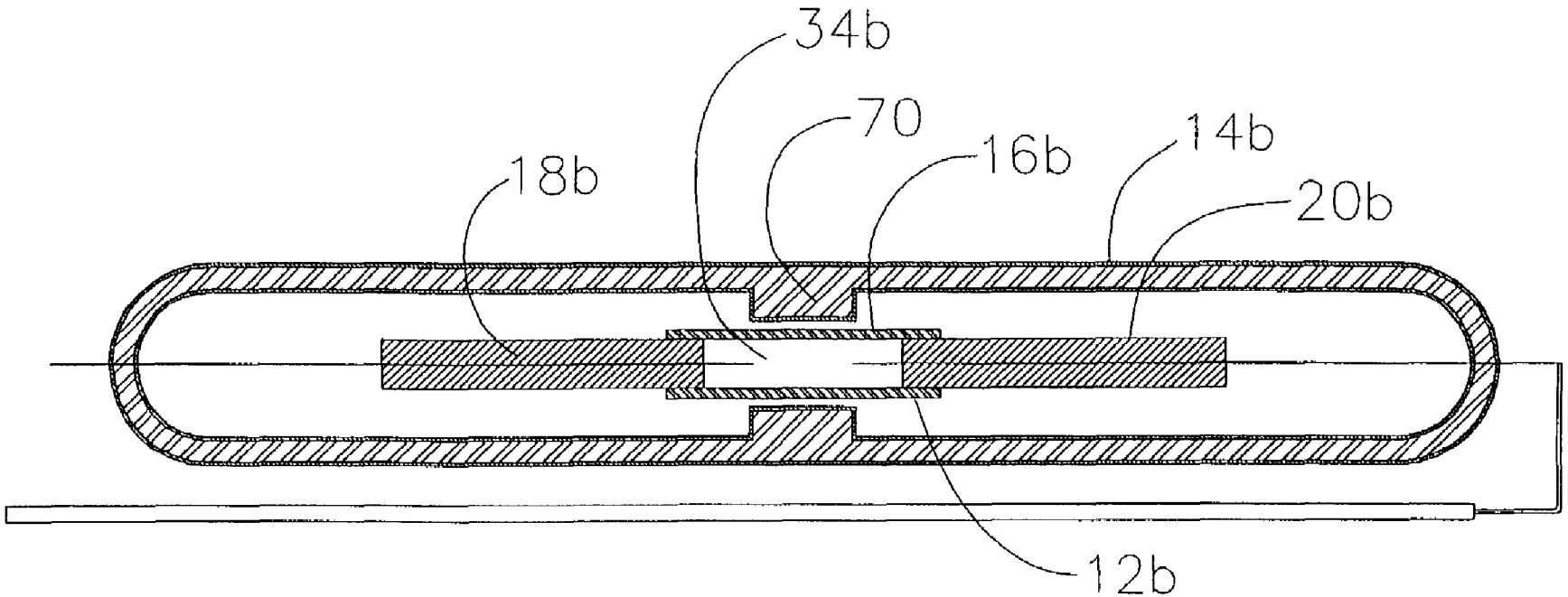
FIG. 3 diagrammatically shows a lamp according to the invention where the shroud wall is thick only along the section of the arctube which is adjacent to the arc gap.
Figure 4:
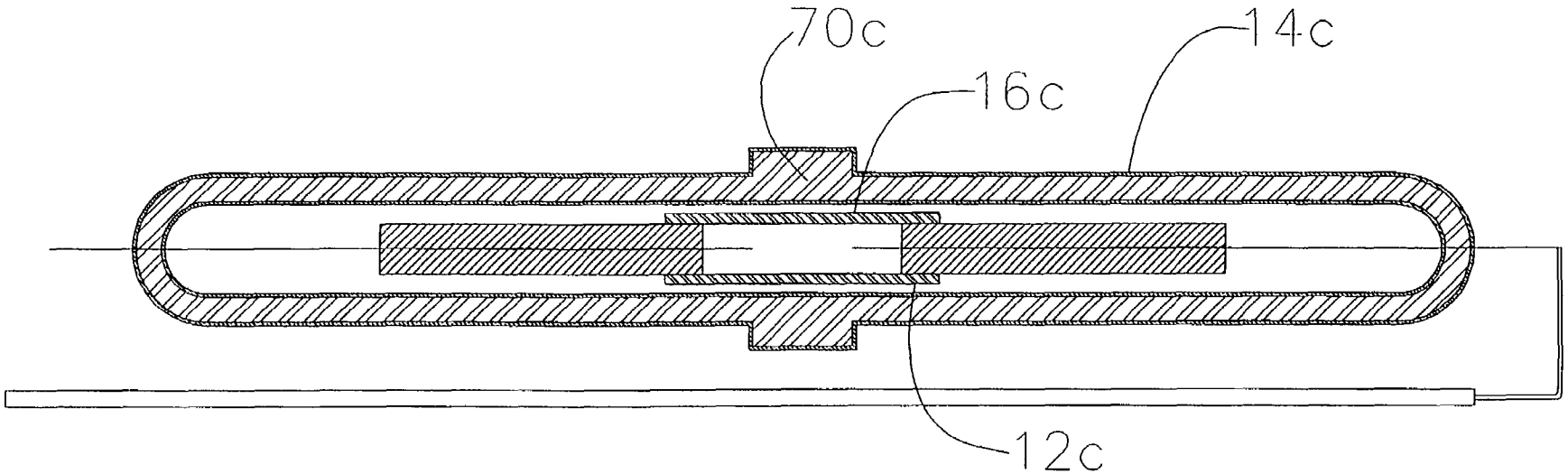
FIG. 4 diagrammatically shows a lamp according to an alternative embodiment where the shroud wall is thick only along the section of the arctube which is adjacent to the arc gap.

FIG. 3 shows a lamp having a shroud 14*b* and an arctube 12*b* having a light-transmitting envelope 16*b*. Shroud 14*b* has a thickened portion 70 which is of uniform thickness circumferentially around the waist of the shroud. Thickened portion 70 is preferably at least 10, 20, 25, 30, 40, 50, 70, 90, 100, 120, 150, 200, 250, 300, 400 or 500, % thicker than substantially the rest of the shroud or the adjacent portions of the shroud as shown. The thickened portion 70 preferably extends or is located adjacent the central portion of the arctube, preferably centered at the midpoint between the tips of the electrodes as shown, preferably extending adjacent the entire discharge space 34*b* (the space confined by the envelope 16*b* and the two legs 18*b*, 20*b*), or extending adjacent the portion between the tips of the two electrodes (the arc portion of the arctube) as shown in FIG. 3, or extending adjacent at least 10, 20, 30, 40, 50, 60, 70, 80, 90 or 95, % of (a) the discharge space 34*b* or (b) the space or portion between the tips of the two electrodes (the arc portion of the arctube). FIG. 4 shows a lamp substantially the same as in FIG. 3, having a shroud 14*c* and an arctube 12*c* having a light-transmitting envelope 16*c*. Shroud 14*c* has a thickened portion 70*c* like thickened portion 70 except it is on the outside of the shroud instead of on the inside of the shroud. Alternatively, the thickened portion can be partly on the inside and partly on the outside of the shroud.

Figure 5:
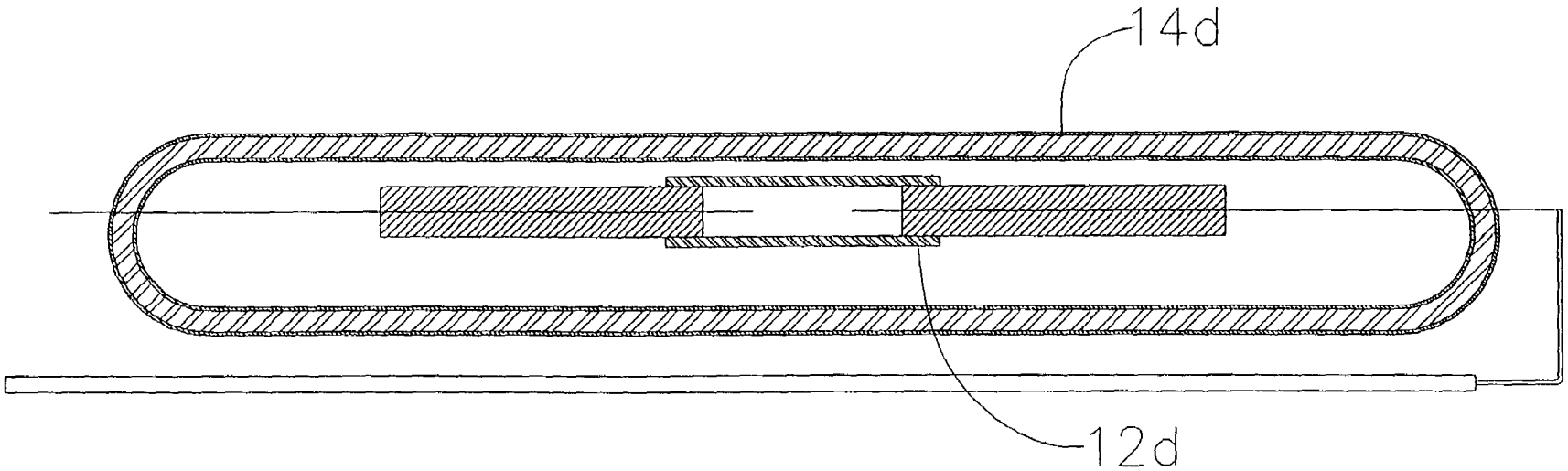
FIG. 5 diagrammatically shows a lamp according to the invention where the arctube is mounted with an offset vertically above the center of the shroud.

As shown in FIG. 5, the longitudinal axis of the arctube 12*d* can be located or fixed above (above meaning above during operation of the lamp) the longitudinal axis of the shroud 14*d*, preferably at least 0.1, 0.2, 0.5, 1, 2, 3, 4, 5, 6, 7, 8, 10, 13, 15, 20, 25, 30, 35, 40, 45, 48, % (compared to the inside diameter of the shroud) above the shroud longitudinal axis. FIG. 5 illustrates a design effective to beneficially modify an azimuthal temperature gradient of the arctube.

Figure 6:
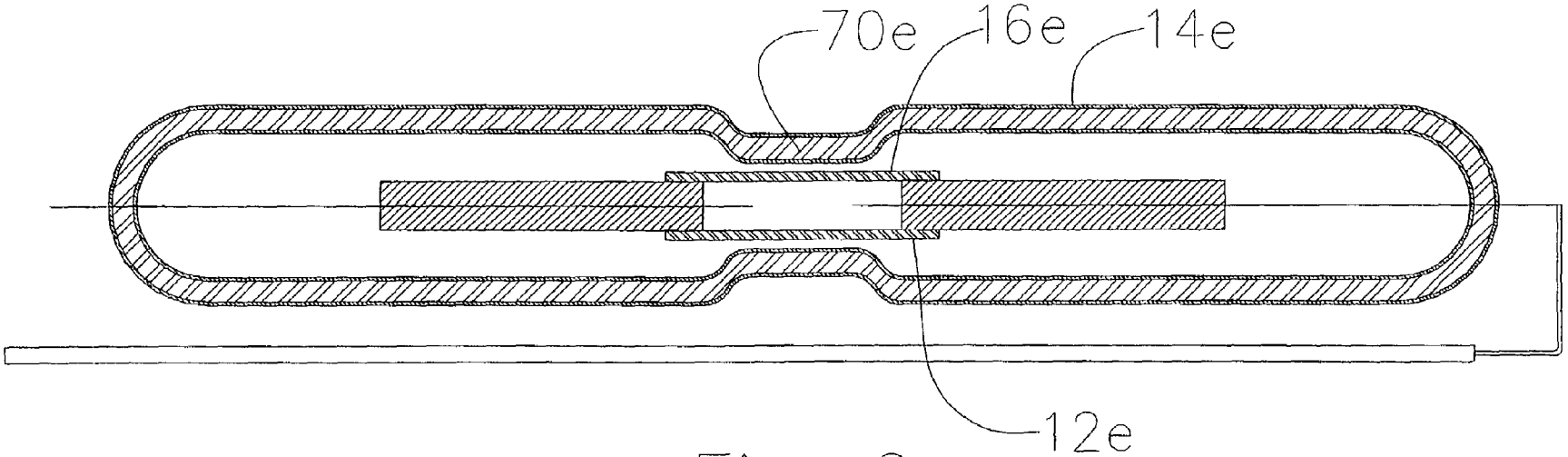
FIG. 6 diagrammatically shows a lamp according to the invention where the gap between the outside surface of the arctube and the inside surface of the shroud is reduced along the section of the arctube which is adjacent to the arc gap.

FIG. 6 shows a lamp having a shroud 14*e* and an arctube 12*e* having a light-transmitting envelope 16*e*. FIG. 6 is like FIG. 3, except that the thickened portion 70 in FIG. 3 is replaced by a portion 70*e* of the shroud which has a narrower or smaller inside and outside diameter but not a different thickness. This portion 70*e* extends or is located adjacent the same preferred central portions of the arctube as discussed above for portion 70. The inside diameter of portion 70*e* is preferably at least 1, 2, 3, 5, 8, 10, 15, 20, 25, 30, 40, 50, 60, 70 or 80, % smaller than the inside diameter of the adjacent portions of the shroud 14*e*. FIG. 6 illustrates one way the thickness of the gap 62 can be varied to beneficially modify the axial temperature gradient.

FIG. 7 shows a lamp having a shroud 14*f* and an arctube 12*f* having a light-transmitting envelope 16*f*. Current conductor 24*f* is electrically connected to return lead or lead support 30*f* which extends or is positioned or located vertically above the arctube (above meaning above the arctube during operation of the lamp) in the gap between the outside surface of the arctube 12*f* (and envelope 16*f*) and the inside surface of the shroud 14*f*. An insulating sleeve 72 covers a portion of lead support 30*f* to prevent arcing. Via this design a portion of the heat from the top of the arctube, where cooling is most needed, can be conducted away and dissipated via the metal lead support 30*f*. The ratio of the gap 62 to the diameter of lead support 30*f* in the region of gap 62 is preferably less than 5:1, more preferably less than 3:1, 2:1 or 1.5:1.

Figure 10:
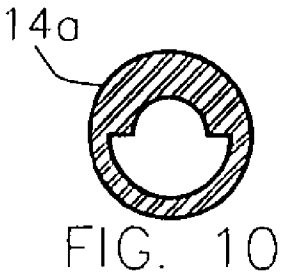
FIG. 10 shows a cross-sectional view of the shroud taken along line 10-10 of FIG. 9*a*.
Figure 11:
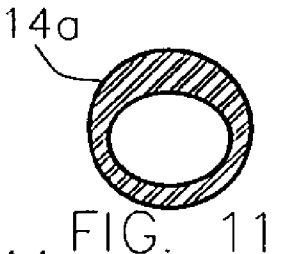
FIG. 11 shows an alternative embodiment of the shroud of FIG. 10.
Figure 12:
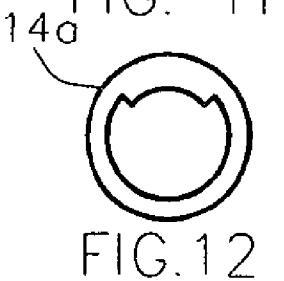
FIG. 12 shows an alternative embodiment of the shroud of FIG. 10 with the cross-hatchings not shown.
Figure 9A:
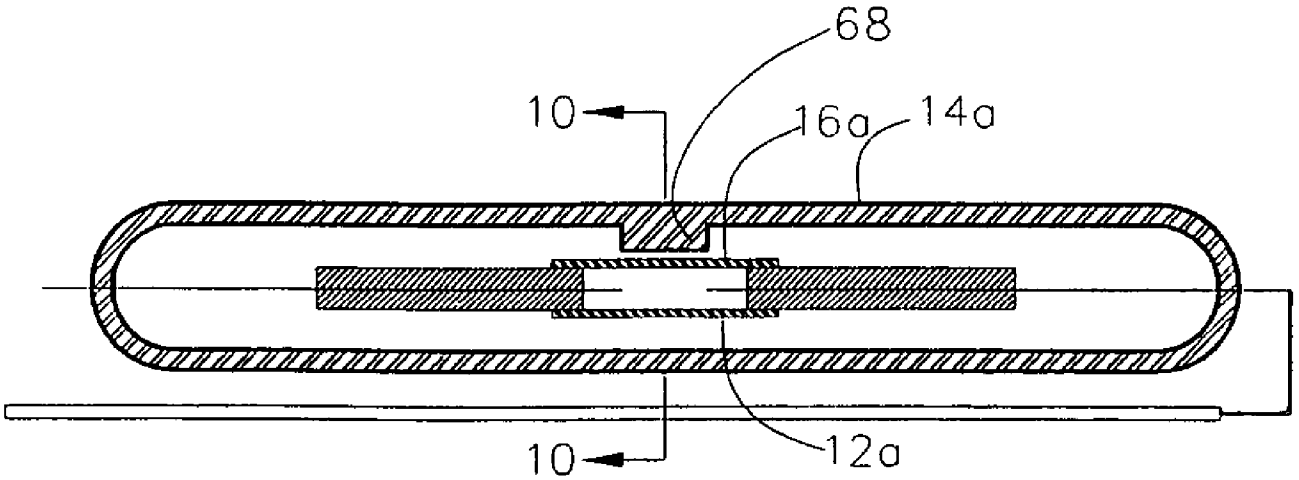
FIG. 9*a* diagrammatically shows a lamp according to the invention wherein an arctube is located concentrically inside an asymmetric shroud.
Figure 9B:
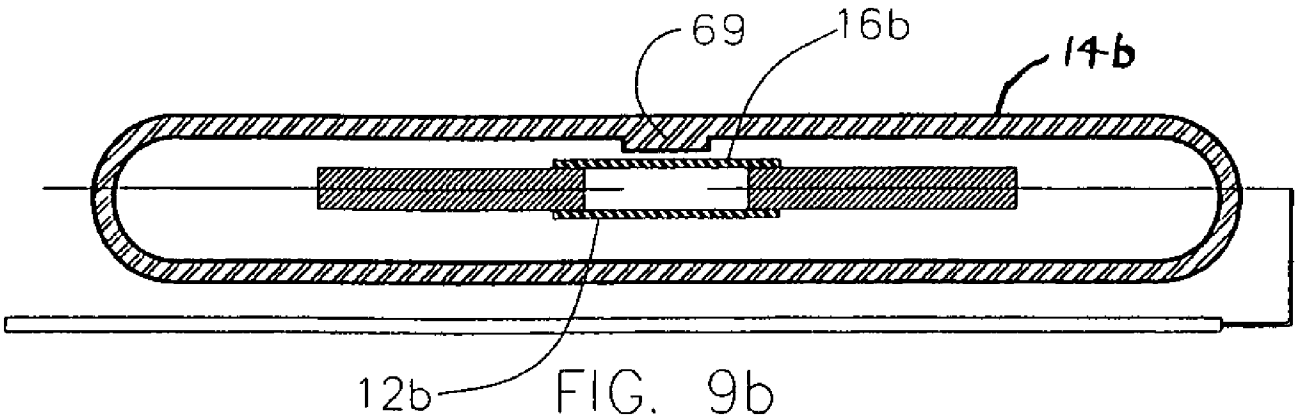
FIG. 9*b* diagrammatically shows a lamp according to the invention wherein the longitudinal axis of an arctube is located vertically above the longitudinal axis of an asymmetric shroud.

In another example, the thickness of the shroud wall may be increased above the arctube relative to that below the arctube, as shown in FIGS. 9*a* and 9*b*. With reference to FIG. 9*a*, there is shown a lamp having a shroud 14*a* and an arctube 12*a* having a light-transmitting envelope 16*a*. FIG. 9*b* shows a similar lamp having a shroud 14*v* and an arctube 12*b* having a light-transmitting envelope 16*b*. Shrouds 14*a* and 14*b* have thickened portions 68, 69, respectively, which are thickened, preferably at least 10, 20, 25, 30, 40, 50, 70, 90, 100, 120, 150, 200, 250, 300, 400 or 500, % thicker than substantially the rest of the shroud or the adjacent portions of the shroud as shown. The thickened portions 68, 69 can extend axially like the thickened portions in FIGS. 3 and 4 and portions 68, 69 are the upper or top portions of the shroud and can be the upper 180°, the upper 150°, 120°, 90°, 60°, or other degrees (see FIGS. 10 and 12), and the thickened portions 68, 69 can be uniformly thick (see FIGS. 10 and 12), or can taper so that the wall gets thicker as it gets closer to the top (see FIG. 11). The shroud designs of FIGS. 9*a* and 9*b* target reduction in circumferential temperature gradients. A shroud 14*a*, 14*b* having a thicker wall above the arctube, especially in the central portion of the arctube directly above the arc or discharge space, as compared to the thickness of the shroud wall at the bottom central portion of the arctube, will lead to uneven cooling of the arctube, providing more cooling on the top as compared to the bottom, significantly reducing the circumferential temperature gradients and the resultant stresses in the arctube. (In the foregoing discussion, the top of the arctube means the top of the arctube during operation, since heat rises and for a variety of reasons the top of the arctube during operation tends to be hotter than the bottom of the arctube during operation). The asymmetric shroud wall thickness may also be combined with the benefit of mounting the arctube the same as in FIG. 5, that is, such that the arctube longitudinal axis is vertically offset from, and vertically higher than or above (during operation), the shroud longitudinal axis (as shown in FIG. 9*b*), both having the effect of reducing the vertical and circumferential temperature gradients and the resultant stresses in the arctube. In another example, the gap 62 between the outside of the arctube and the inside of the shroud may be varied along the axial direction due to axial variation in either the arctube outside diameter and/or the shroud inside diameter, as in FIG. 6. Wherever the gap 62 is smaller, the cooling effect of the shroud on the local temperature of the arctube will be greater, so that a shroud with a smaller diameter near the arc region than near the electrode region of the arctube will advantageously reduce the hot spot temperature of the arctube relative to the cold spot of the arctube. Thus the arctube has an axial temperature gradient during operation. For example, (a) the shroud wall thickness may be varied, or (b) the thickness of the gap between arctube envelope and shroud may be varied, or (c) both may be varied, in a manner effective to lower the hot spot temperature (such as at the top central part of the arctube arc chamber or envelope) and thus in a manner effective to beneficially modify the axial temperature gradient. Similarly, if the arctube diameter is larger near the arc and smaller near the electrodes, while the inside diameter of the shroud is constant in those regions, then the closer proximity of the shroud to the outside of the arctube near the arc will also advantageously reduce the hot spot temperature relative to the cold spot. This is the situation that would be obtained with an approximately elliptically (i.e. prolate spheroid) shaped arctube and a cylindrically shaped shroud, for example. An approximately elliptical shape arctube can generally be designed to have a more isothermal temperature distribution in the region of the arc and the electrodes, and in combination with a cylindrical shroud having constant inside diameter, the elliptical arctube will operate with even more isothermal temperature distribution. Furthermore, the greater the cooling effect of the shroud (i.e. smaller gap 62, and/or thicker shroud wall and/or a cooling gas such as He) the greater will be the isothermalizing effect of the cylindrical shroud in combination with an elliptical arctube.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lamp comprising an arctube having a light-transmitting envelope and a pair of spaced apart electrodes, said arctube being surrounded by a gaseous medium confined by a containment envelope external to the arctube, said light-transmitting envelope having an outside surface and an outside diameter, said containment envelope being a shroud having an inside surface and an inside diameter, there being a gap between the outside surface of said light-transmitting envelope and the inside surface of said shroud, said gap being less than 10% of the outside diameter of said light-transmitting envelope.

2. The lamp of claim 1, wherein said shroud has an outside surface and an outside diameter, said shroud having a wall thickness between said outside and inside surfaces, said wall thickness of said shroud being greater than 10% of the inside diameter of said shroud.

3. The lamp of claim 1, said shroud having a longitudinal axis, said arctube having a longitudinal axis, said arctube longitudinal axis being vertically offset from said shroud longitudinal axis.

4. The lamp of claim 1, said arctube having an arc portion, the wall thickness of a first portion of the shroud adjacent the arc portion being greater than the wall thickness of a second portion of the shroud spaced apart from said first portion.

5. A lamp comprising an arctube having a light-transmitting envelope and a pair of spaced apart electrodes, said arctube being surrounded by a gaseous medium confined by a containment envelope external to the arctube, said light-transmitting envelope having an outside surface and an outside diameter, said containment envelope being a shroud having an inside surface and an inside diameter, wherein the difference between the outside diameter of the light-transmitting envelope and the inside diameter of the shroud is less than 0.3 times the outside diameter of the light-transmitting envelope.

6. A lamp comprising an arctube having a light-transmitting envelope and a pair of spaced apart electrodes, said arctube being surrounded by a gaseous medium confined by a containment envelope external to the arctube, said light-transmitting envelope having an outside surface and an outside diameter, said containment envelope being a shroud having an inside surface and an inside diameter and an outside surface and an outside diameter, said shroud having a wall thickness between said outside and inside surfaces, said wall thickness of said shroud being greater than 20% of the inside diameter of said shroud.

7. A lamp comprising an arctube having a light-transmitting envelope and a pair of spaced apart electrodes, said arctube being surrounded by a gaseous medium confined by a shroud external to the arctube, said arctube having an arc portion, the wall thickness of a first portion of the shroud adjacent the arc portion being greater than the wall thickness of a second portion of the shroud spaced apart from said first portion.

8. The lamp of claim 7, the wall thickness of a portion of the shroud above the arc portion being greater than the wall thickness of a portion of the shroud below the arc portion.

9. The lamp of claim 7, wherein the wall thickness of the first portion is at least twice the wall thickness of the second portion.

10. A lamp comprising an arctube having a light-transmitting envelope and a pair of spaced apart electrodes, said arctube being surrounded by a gaseous medium confined by a shroud external to the arctube, said shroud having a longitudinal axis, said arctube having a longitudinal axis, said arctube longitudinal axis being vertically offset from said shroud longitudinal axis.

11. The lamp of claim 10, wherein said lamp is mounted and wherein said arctube longitudinal axis is substantially horizontal and is above said shroud longitudinal axis.

12. The lamp of claim 10, said arctube having an arc portion, the wall thickness of a first portion of the shroud adjacent the arc portion being greater than the wall thickness of a second portion of the shroud spaced apart from said first portion.

* * * * *